US010288237B2

(12) United States Patent
Li

(10) Patent No.: US 10,288,237 B2
(45) Date of Patent: May 14, 2019

(54) LED LIGHT STRIP AND ILLUMINATION SYSTEM

(71) Applicant: BLUEVIEW ELEC-OPTIC TECH CO., LTD., Shuangliu, Chengdu (CN)

(72) Inventor: Zhongxun Li, Chengdu (CN)

(73) Assignee: BLUEVIEW ELEC-OPTIC TECH CO., LTD., Chengdu (CN)

( * ) Notice: Subject to any disclaimer, the term of this patent is extended or adjusted under 35 U.S.C. 154(b) by 0 days.

(21) Appl. No.: 15/756,530

(22) PCT Filed: Apr. 21, 2017

(86) PCT No.: PCT/CN2017/081523

§ 371 (c)(1),
(2) Date: Feb. 28, 2018

(87) PCT Pub. No.: WO2018/170994

PCT Pub. Date: Sep. 27, 2018

(65) Prior Publication Data

US 2018/0299082 A1 Oct. 18, 2018

(30) Foreign Application Priority Data

Mar. 20, 2017 (CN) ..... 2017 1 0164210

(51) Int. Cl.
*F21S 4/28* (2016.01)
*F21V 21/005* (2006.01)
(Continued)

(52) U.S. Cl.
CPC . *F21S 4/28* (2016.01); *F21S 4/22* (2016.01); *F21V 15/01* (2013.01); *F21V 19/004* (2013.01);
(Continued)

(58) Field of Classification Search
CPC ..... F21S 4/28; F21V 15/01; F21V 19/004; F21V 21/14; F21V 23/06
See application file for complete search history.

(56) References Cited

U.S. PATENT DOCUMENTS 7,293,895 B2 * 11/2007 Grossman ..... F21S 2/00 174/110 R
8,408,743 B1 * 4/2013 Chen ..... F21V 29/20 362/249.02
(Continued)

FOREIGN PATENT DOCUMENTS

CN 204756802 U 11/2015
CN 205001935 U 1/2016
(Continued)

OTHER PUBLICATIONS

International Search Report dated Aug. 29, 2017 as issued in connection with International Patent Application No. PCT/CN2017/081523.

*Primary Examiner* — Anabel Ton
(74) *Attorney, Agent, or Firm* — Maschoff Brennan

(57) ABSTRACT

Provided is an LED lamp strip and a lighting system. The LED lamp strip comprises a lamp strip body, an installing groove, a first connection assembly, a second connection assembly and third connection assemblies. The lamp strip body arranged in the installing groove comprises opposite first and a second end portions. The first connection assembly is connected with the first end portion for connecting the lamp strip body with an external power source and the second connection assembly is connected with the second end portion for blocking the same. Lamp bars are arranged between the first and second end portions; the third connection assemblies are arranged between the adjacent lamp bars for electrically connecting them. Each lamp bar comprises a shell, a circuit board arranged in the shells and an LED
(Continued)

lamps arranged on the circuit boards; and gaps exist between the LED lamps and the shells.

18 Claims, 6 Drawing Sheets

(51) Int. Cl.

| | |
|---|---|
| ***F21V 23/06*** | (2006.01) |
| ***F21S 4/22*** | (2016.01) |
| ***F21V 15/01*** | (2006.01) |
| ***F21V 19/00*** | (2006.01) |
| ***F21V 21/14*** | (2006.01) |
| *F21S 2/00* | (2016.01) |
| *F21V 15/015* | (2006.01) |
| *F21Y 103/10* | (2016.01) |
| *F21Y 115/10* | (2016.01) |
| *H01R 13/516* | (2006.01) |
| *H01R 25/16* | (2006.01) |

(52) U.S. Cl.
CPC ..... *F21V 21/005* (2013.01); *F21V 21/14* (2013.01); *F21V 23/06* (2013.01); *F21S 2/005* (2013.01); *F21V 15/015* (2013.01); *F21Y 2103/10* (2016.08); *F21Y 2115/10* (2016.08); *H01R 13/516* (2013.01); *H01R 25/162* (2013.01)

(56) References Cited

U.S. PATENT DOCUMENTS

| | | | | |
|---|---|---|---|---|
| 8,459,834 | B2 * | 6/2013 | Chang | F21S 4/28 362/219 |
| 2008/0198590 | A1 | 8/2008 | Kuo et al. | |
| 2009/0147504 | A1 * | 6/2009 | Teeters | F21V 23/06 362/153 |
| 2016/0356433 | A1 | 12/2016 | Xu | |
| 2017/0122540 | A1 * | 5/2017 | Dull | F21S 4/28 |

FOREIGN PATENT DOCUMENTS

| | | | |
|---|---|---|---|
| CN | 105351799 | A | 2/2016 |
| CN | 105387375 | A | 3/2016 |
| CN | 205278856 | U | 6/2016 |
| CN | 205278858 | U | 6/2016 |
| CN | 106122823 | A | 11/2016 |

* cited by examiner

LED LIGHT STRIP AND ILLUMINATION SYSTEM

The present disclosure claims priority to Chinese patent application No. CN 201710164210.8, filed on Mar. 20, 2017 with the State Intellectual Property Office, and entitled "LED Light Strip and Illumination System", which is incorporated herein by reference in its entirety.

TECHNICAL FIELD

The present disclosure relates to the technical field of luminaire, and particularly to an LED light strip and an illumination system using the LED light strip.

BACKGROUND ART

In the prior art, an LED luminaire cannot be flexibly adjusted according to different application environments or user needs as its structure and dimension alike have been determined after manufacturing, so that it enjoys extremely poor flexibility. In addition, some LED luminaires can be adjusted in a personalized way, but they have complex structure, complicated assembly, and low reliability, resulting in an increased manufacturing cost, and an unstable performance of the LED luminaire, thereby leaving the current social needs dissatisfied.

DISCLOSURE OF THE INVENTION

In order to overcome the prior disadvantages as mentioned, one of the objects in the present disclosure includes providing an LED light strip with flexibility in adjusting the structure or dimension according to different environments. Such strong environmentally adaptable light strip is simple in structure, convenient to assemble, and capable of satisfying the application requirements in different environments.

The other object of the present disclosure includes providing an illumination system with flexibility in adjusting the structure or dimension according to different environments. Such strong environmentally adaptable light strip is simple in structure, convenient to assemble, and capable of satisfying the application requirements in different environments.

In order to realize the above objects, a technical solution provided in a preferable example of the present disclosure is as follows:

an LED light strip is provided in a preferable example of the present disclosure. The LED light strip includes a light strip, a mounting groove, a first connecting assembly, a second connecting assembly, and a third connecting assembly.

The light strip is arranged in the mounting groove.

The light strip includes a first end portion and a second end portion which are opposite to each other, wherein the first connecting assembly is connected with the first end portion for electrically connecting the light strip with an external power supply, and the second connecting assembly is connected with the second end portion for blocking off the second end portion.

A plurality of light bars are arranged between the first end portion and the second end portion, and the third connecting assembly is arranged between adjacent light bars for electrically connecting the adjacent light bars.

Each of the light bars includes an outer housing, a circuit board, and an LED lamp. The circuit board is arranged within the outer housing along an extending direction of the light bar, and the LED lamp is arranged on the circuit board, and a gap is present between the LED lamp and the outer housing.

In a preferable example of the present disclosure, the mounting groove includes:

an mounting groove body for receiving the light strip; and an mounting-groove snap-fitting element for fixing the light strip in the mounting groove body, wherein the mounting-groove snap-fitting element is fixed in the mounting groove body.

In a preferable example of the present disclosure, the mounting groove body includes positioning grooves for fixing the mounting-groove snap-fitting element and a plurality of mounting holes for mounting the LED light strip in an external environment.

In a preferable example of the present disclosure, the mounting groove body has two side plates arranged opposite to each other and a connecting plate connected between the two side plates, each of the side plates is provided with at least two snap-fitting element stoppers and at least one of the positioning grooves, the positioning groove is located between two adjacent snap-fitting element stoppers, and the positioning grooves of the two side plates are corresponding to each other, and the mounting holes are arranged on the connecting plate.

In a preferable example of the present disclosure, the mounting groove body substantially is in a U-shaped structure, and the connecting plate is connected at ends located at a same side, of the two side plates.

In a preferable example of the present disclosure:

the mounting-groove snap-fitting element includes one position-limiting portion and two clamping portions;

the position-limiting portion is located between the two clamping portions, the position-limiting portion is in contact with the light strip so as to limit the position of the light strip, and the two clamping portions are configured to cooperate with the position-limiting portion to clamp and fix the light strip within the mounting groove; and the two clamping portions are provided thereon with a plurality of first gripping teeth for gripping the light strip, and handlebars for detaching the mounting-groove snap-fitting element.

In a preferable example of the present disclosure, the two clamping portions respectively abut against inner sides of the two side plates of the mounting groove body, and the handlebar is embedded in the positioning groove.

In a preferable example of the present disclosure, the first connecting assembly includes a first connecting element and a first connecting housing.

The first connecting element includes a first connecting element body, first plug pins, and power lines. The first plug pins and the power lines are electrically connected with each other and are respectively arranged at two opposite ends of the first connecting element body, and the first plug pins are electrically connected with the light bar for directing current passing through the power lines into the light bar.

A first stopper is provided on the first connecting element body, and a first clamping groove is formed between the first stopper and the first connecting element body, where the first connecting housing is locked by the first clamping groove for fixing the first connecting element and the first connecting housing.

In a preferable example of the present disclosure, the first connecting housing includes a first housing and a second housing, the first housing and the second housing are provided with a folding spine therebetween, for making the first housing and the second housing superposed one on another. The first housing and the second housing are provided thereon with a first clamping part, a protrusion and second gripping teeth, the protrusion is configured for preventing the first housing and the second housing which are superposed one on another from rebounding, and the second gripping teeth are configured for gripping the light strip, and the first clamping part is snapped with the first clamping groove for fixing the first connecting element and the first connecting housing.

In a preferable example of the present disclosure, the first housing is provided thereon with a first snap-fitting element, and the second housing is provided thereon with a first snap-fitting hole, and the first snap-fitting element is in cooperation with the first snap-fitting hole to fix the first housing and the second housing.

In a preferable example of the present disclosure, a first snap-fitting plate is provided on one end of the first housing away from the second housing, where the first snap-fitting hole is provided in the first snap-fitting plate and a fixing groove is provided between the protrusion of the first housing and the first snap-fitting plate. A second snap-fitting plate is provided at one end of the second housing away from the first housing, where the first snap-fitting element is provided in the second snap-fitting plate; the second snap-fitting plate is embedded in the fixing groove; and a side wall of the first snap-fitting plate abuts against the protrusion.

In a preferable example of the present disclosure, the second connecting assembly includes a second connecting element and a second connecting housing.

The second connecting element includes a second connecting element body and a short tongue-shaped member, where one end of the short tongue-shaped member is connected with the second connecting element body, and the other end of the short tongue-shaped member is connected with the light bar.

A second stopper is provided on the second connecting element body, and a second clamping groove is formed between the second stopper and the second connecting element body for snapping the second connecting assembly with the second connecting housing.

In a preferable example of the present disclosure, the third connecting assembly includes a third connecting element and a third connecting housing.

The third connecting element includes a third connecting element body and third plug pins, each of the third plug pins is arranged at one of two ends of the third connecting element body, and the third plug pins at the two ends are respectively electrically connected with the adjacent light bars.

The third connecting housing is provided thereon with a plurality of pairs of skeleton members, where a third clamping groove is formed between the skeleton members of each pair and configured for clamping the third connecting elements.

In a preferable example of the present disclosure, a fourth connecting assembly, further provided between the adjacent light strips and configured for connecting two light bars perpendicular to each other, includes a fourth connecting element and two fourth connecting housings.

The fourth connecting element includes a fourth connecting element body and fourth plug pins, the fourth plug pins are electrically connected with the two light bars perpendicular to each other, and the fourth plug pins are connected with the fourth connecting element body.

The fourth connecting element is clamped in and fixed with the fourth connecting housing.

An illumination system is further provided in a preferable example of the present disclosure. The illumination system includes a power supply system and the above LED light strip, where the power supply system is electrically connected with the LED light strip for supplying power to the LED light strip.

Compared with the prior art, the present disclosure has the following beneficial effects:

for the a LED light strip and the illumination system provided in the present disclosure, the LED light strip is provided with the light strip, the installation groove, the first connecting assembly, the second connecting assembly, and the third connecting assembly. The light strip is provided in the mounting groove. The light strip includes the opposite first end portion and second end portion. The first connecting assembly is connected with the first end portion for connecting the light strip to the external power supply, and the second connecting assembly is connected with the second end portion for blocking off the second end portion. A plurality of light strips are provided between the first end portion and the second end portion, and the third connecting assembly is provided between the adjacent light strips for electrically connecting the adjacent light strips. Each light strip includes the outer housing, the circuit board, and the LED lamp, where a gap is present between the LED lamp arranged on the circuit board, and the outer housing within which the circuit board is arranged. The above design is able to satisfy the application requirements in different environments as it can flexibly adjust structure or dimension according to different environments, with simple structure, convenient assembly, low manufacture cost, and strong environment adaptability.

BRIEF DESCRIPTION OF DRAWINGS

In order to clarify the technical solutions of the examples of the present disclosure, the drawings used below for the description of the examples will be introduced briefly. It should be understood that the drawings described below merely show some examples of the present disclosure, and therefore should not be considered as limiting the scope. A person skilled in the art can also obtain other relevant drawings according to these drawings, without paying inventive efforts.

REFERENCE SIGNS

Figure 1:
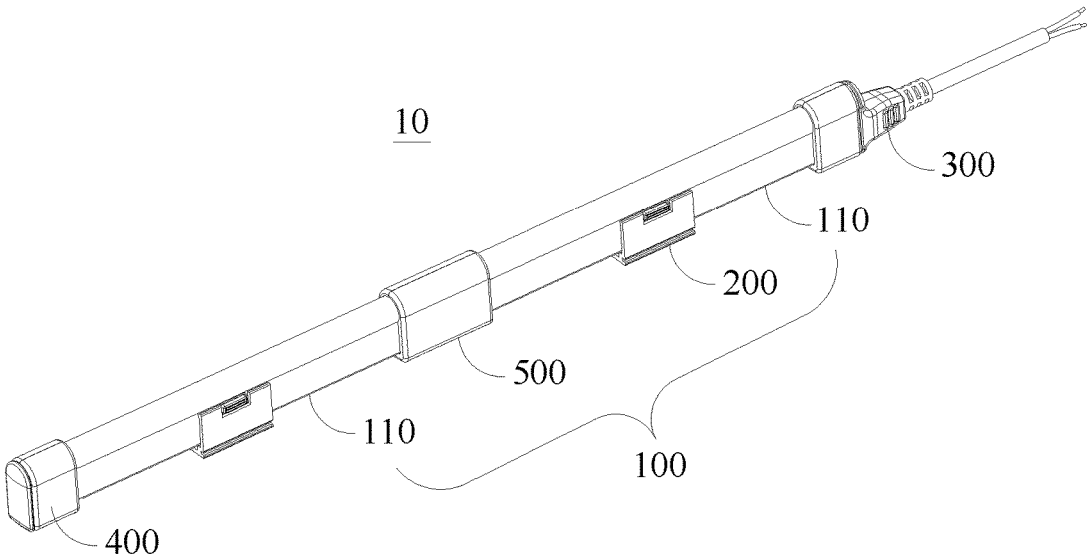
FIG. 1 is a structural schematic view of an LED light strip provided in a preferable example of the present disclosure.

10—LED light strip; 100—light strip; 200—mounting groove; 300—first connecting assembly; 400—second connecting assembly; 500—third connecting assembly; 600—fourth connecting assembly; 110—light bar; 112—outer housing; 1122—light-transmitting silica gel; 1124—light-blocking silica gel; 114—circuit board; 116—LED lamp; 210—mounting-groove snap-fitting element; 212—position-limiting portion; 214—clamping portion; 216—first gripping tooth; 218—handlebar; 230—mounting groove body; 232—positioning groove; 234—mounting hole; 236—snap-fitting element stopper; 310—first connecting element; 312—first connecting element body; 314—first plug pin; 316—power line; 318—first stopper; 319—first clamping groove; 320—first connecting housing; 322—first housing; 3221—first clamping part; 3223—protrusion; 3224—second gripping tooth; 3225—first snap-fitting element; 324—second housing; 3241—first snap-fitting hole; 326—folding spine; 410—second connecting element; 412—second connecting element body; 414—short tongue-shaped member; 416—second stopper; 418—second clamping groove; 420—second connecting housing; 510—third connecting element; 512—third connecting element body; 514—third plug pin; 520—third connecting housing; 522—skeleton member; 524—third clamping groove; 620—fourth connecting element; 622—fourth connecting element body; 6222—first side face; 6224—second side face; 624—fourth plug pin; 640—fourth connecting housing.

DETAILED DESCRIPTION OF EMBODIMENTS

The objects, technical solutions, and advantages of the examples in the present disclosure will be described clearly and comprehensively by referring to the figures below. Apparently, some but not all of the examples in the present disclosure are described. Generally, in the examples of the present disclosure, the components as described and shown in the figures herein can be arranged and designed in different configurations.

Therefore, it is not intended to limit the scope of protection of the present disclosure, but merely to illustrate the chosen examples of the present disclosure when describing the examples of the present disclosure in detail. Based on the examples of the present disclosure, all of the other examples, obtained by a person skilled in the art without paying inventive efforts, should fall within the scope of protection of the present disclosure.

It should be noted that any similar reference signs and alphabets would represent similar items in the following figures. Therefore, once there was a certain item defined in one figure, no further definition or explanation is necessary in subsequent figures. It also should be indicated that various examples of the present disclosure are described herein in a progressive manner, with the emphasis of each of the examples on the difference between it and the other examples, and thus, one can refer to the other examples, for the same or similar parts between the examples.

In the description of the present disclosure, it should be noted that the orientational or positional relationships indicated by terms such as "inner" and "outer" are based on the orientational or positional relationships as shown in the figures, or the orientational or positional relationships in which the product of this disclosure is conventionally placed, merely for facilitating describing the present disclosure and simplifying the description, rather than indicating or suggesting that related devices or elements have to be in a specific orientation or configured and operated in a specific orientation, and therefore, they should not be construed as limiting the present disclosure. Besides, terms such as "first", "second", and "third" are merely for descriptive purpose, but should not be construed as indicating or implying a relative importance.

In the description of the present disclosure, it also should be noted that unless otherwise specified and defined, the terms "arrange", "mount", "join", and "connect" should be understood in broad sense. For example, a connection can be a fixed connection, a detachable connection, or an integrated connection; it can be a mechanical connection or an electrical connection; and it can be a direct connection or an indirect connection through an intermediate medium; it also can be an inner communication between two elements. For a person ordinarily skilled in the art, specific meanings of the above-mentioned terms in the present disclosure can be understood according to specific conditions.

Below, some examples of the present disclosure will be described in details with reference to the figures. The examples below and features in the examples can be combined with each other without conflict.

Referring to FIG. 1, FIG. 1 shows an LED light strip 10 provided in a preferable example of the present disclosure. It can be understood that in the present example, the LED light strip 10 can be used according to practical requirements, for example, the LED light strip 10 can be used for exterior illumination of buildings, landscape illumination, signage and indicative illumination, indoor display illumination, entertainment venues and stage illumination, vehicle indicator lamp illumination, etc. In this example, there is no specific limitation on the application environments of the LED lamp strip 10.

As shown in FIG. 1, in the present example, the LED light strip 10 can include a light strip 100, a mounting groove 200, a first connecting assembly 300, a second connecting assembly 400, and a third connecting assembly 500.

Optionally, in the present example, the light strip 100 can be arranged in the mounting groove 200 to be fixed. The light strip 100 can include a first end portion and a second end portion which are opposite to each other, furthermore, a connecting line between the first end portion and the second end portion is parallel to an extending direction of the light strip 100. The first connecting assembly 300 is connected with the first end portion for electrically connecting the light strip 100 with an external power supply, and the second connecting assembly 400 is connected with the second end portion for blocking off the second end portion.

A plurality of light bars 110 are arranged between the first end portion and the second end portion, and the third connecting assembly 500 is arranged between adjacent light bars 110 for electrically connecting the adjacent light bars 110. It should be noted that in the present example, the specific number of the light bar 110 is not specifically limited, and can be set according to the practical requirements of design. Correspondingly, the third connecting assembly 500 can be flexibly arranged according to the number of the light bar 110.

The light bar 110 can be arranged in number of two, and the third connecting assembly 500 can be arranged in number of one, as an implementation of the present example.

Through the above design, the LED light strip 10 can be flexibly adjusted in structure or dimension according to different application environments, so as to meet requirements for different environments; moreover, it is simple to detach, has low cost for users to learn, and the light bar 110 and the third connecting assembly 500 simply need to be added when there is a need for dimension increasing.

Figure 2:
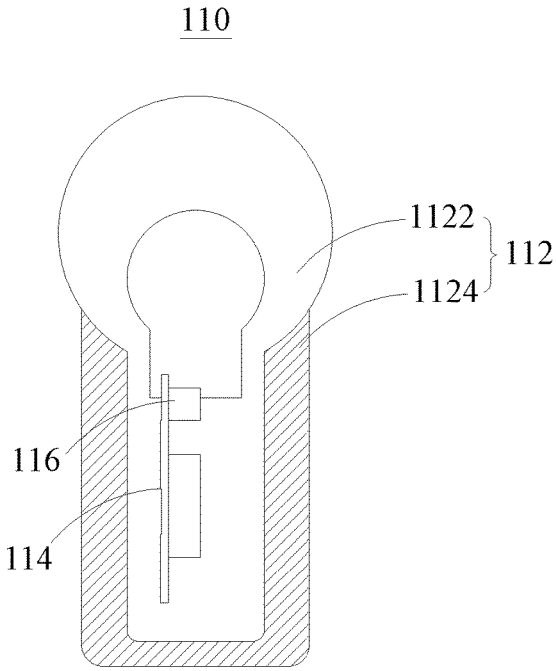
FIG. 2 is a sectional schematic view of a light bar provided in a preferable example of the present disclosure.

Furthermore, refer to FIG. 2 for the specific structure of the light bar 110. The light bar 110 can include an outer housing 112, a circuit board 114, and an LED lamp 116. Optionally, the circuit board 114 is arranged within the outer housing 112 along an extending direction of the light bar 110, and the LED lamp 116 is arranged on the circuit board 114.

In the present example, the above outer housing 112 can include a light-transmitting silica gel 1122 and a light-blocking silica gel 1124. Exemplarily, the outer housing 112 can be integrally formed by extruding the light-transmitting silica gel 1122 and the light-blocking silica gel 1124. The light-transmitting silica gel 1122 wraps the circuit board 114 and the LED lamp 116. The light-transmitting silica gel 1122 includes a wrapping portion with a circular section and a rectangular bearing portion, where the wrapping portion is connected with the bearing portion. The light-blocking silica gel 1124 is sleeved outside the bearing portion, and partially wraps a connecting portion of the bearing portion and the wrapping portion, so that the light bar 110 has a smooth light-emitting face, with uniform light emission, and the face which does not need to emit light can be completely blocked by the light-blocking silica gel 1124.

In the present example, preferably, the circuit board 114 can be a flexible printed circuit board (FPC). The flexible printed circuit board has the advantages of high assembly density, small volume, light weight, convenient installation, and high reliability.

In addition, in the present example, in order to avoid color difference during extrusion after contacting the LED lamp 116 with the outer housing 112, affecting the quality of the product, a gap can be provided between the LED lamp 116 and the outer housing 112 as one implementation, so as to solve the problem of damaging the LED lamp 116 due to solid extrusion or high temperature and high pressure, and the problem of color temperature difference caused by uneven surface contact of the solid extruded material with the LED lamp 116, and also remove the defect that a full-hollow outer housing 112 cannot be provided with a part capable of being cut after extrusion, achieving multiple purposes with one measure, greatly improving the practical value of the product.

The light bar 110 with the above design, which is formed by extruding the outer housing 112 employing the light-transmitting silica gel 1122 and the light-blocking silica gel 1124 with the flexible printed circuit board, can be arbitrarily bent, has a high adaptability to the environments, and can meet applications for various environments.

Figure 3:
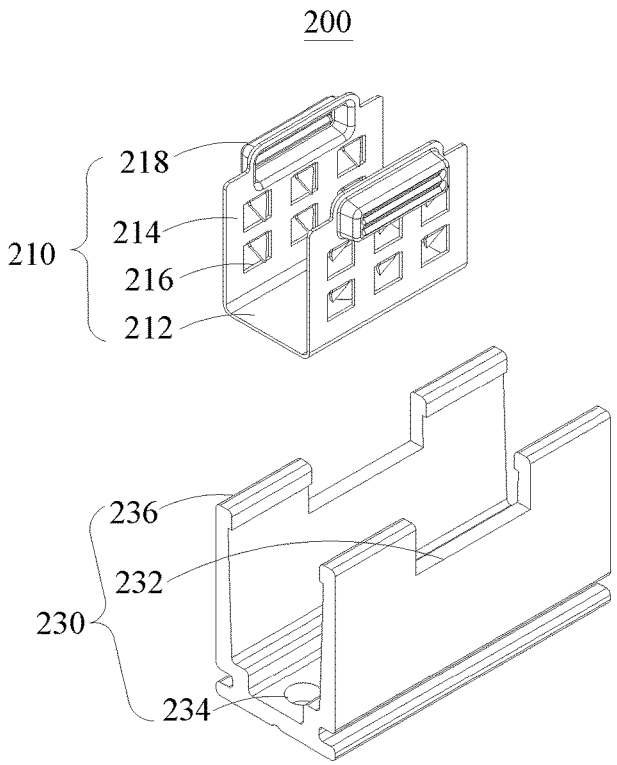
FIG. 3 is a structural schematic view of a mounting groove provided in a preferable example of the present disclosure.

Furthermore, refer to FIG. 3 for the specific structure of the mounting groove 200. The mounting groove 200 can include a mounting groove body 230 and a mounting-groove snap-fitting element 210. Optionally, the mounting-groove snap-fitting element 210 is fixed in the mounting groove body 230.

The mounting groove body 230 is used for fixing the mounting-groove snap-fitting element 210 and receiving the light strip 110. Optionally, as shown in FIG. 3, the mounting groove body 230 can include a positioning groove 232 for fixing the mounting-groove snap-fitting element 210, a plurality of mounting holes 234 for mounting the LED light strip 10 in the external environment, and a snap-fitting element stopper 236 for cooperating with the mounting-groove snap-fitting element 210.

In the present example, the mounting groove body 230 substantially is in a U-shaped structure, which has two side plates arranged opposite to each other and a connecting plate connected at the ends, located at a same side, of the two side plates. Each of the side plates is provided with at least two snap-fitting element stoppers 236 and at least one of the positioning grooves 232, the positioning groove 232 is located between two adjacent snap-fitting element stoppers 236, and the positioning grooves 232 of the two side plates are corresponding to each other. In the present example, the snap-fitting element stopper 236 is in number of two, and the positioning groove is in number of one. The number of both can also be determined surely according to practical situations. Besides, the mounting holes 234 are arranged on the connecting plate.

The mounting-groove snap-fitting element 210 is used for fixing the light strip 100 in the mounting groove body 230. Optionally, the mounting-groove snap-fitting element 210 substantially is in a U-shaped structure, which can include one position-limiting portion 212 and two clamping portions 214. The position-limiting portion 212 is located between the two clamping portions 214, and is connected with the same sides of the two clamping portions 214. The position-limiting portion 212 is in contact with the light strip 100 so as to limit the position of the light strip 100, and the two clamping portions 214 are configured to cooperate with the position-limiting portion 212 to clamp and fix the light strip 100 within the mounting groove 200.

Furthermore, the two clamping portions 214 are both provided with a plurality of first gripping teeth 216 for gripping the light strip 100 and handlebars 218 for detaching the mounting-groove snap-fitting element 210. Optionally, the plurality of first gripping teeth are arranged on the two clamping portions 214 in a rectangular array, and the first gripping teeth 216 of the two clamping portions 214 are corresponding one by one. The handlebar 218 is located on the same sides of the two clamping portions 214 away from the position-limiting portion 212, and the handlebars 218 on the two clamping portions 214 are corresponding one by one.

The mounting-groove snap-fitting element 210 can clamp the light strip 100, and can be snapped in the mounting groove body 230. When the mounting-groove snap-fitting element 210 is snapped in the mounting groove body 230, the two clamping portions 214 respectively abut against the inner sides of the two side plates of the mounting groove body 230, and the handlebars 218 are snap-fitted with the positioning groove 232.

When specific implementing, if the light strip 100 is to be taken out from the mounting groove 200, first, the user can take out the mounting-groove snap-fitting element 210 and the light strip 100 simultaneously while holding the handlebars 218, then disengage the two clamping portions 214 to remove the light strip 100. This is quite convenient to operate. In addition, the length of the mounting groove body 230 can be flexibly set up, and the length of the mounting groove body 230 is not specifically limited in the present example.

It should be particularly noted that as one implementation, the mounting-groove snap-fitting element 210 can be made from a metal to ensure that the mounting groove 200 is not prone to deformation when the light strip 100 is fixed.

The light strip 100 can be directly installed in the above mounting groove 200. Such installation is simple and swift, which can be flexibly arranged according to practical requirements. No complex detaching process is needed when the light strip 100 needs to be taken out. This keeps the user's learning cost low and the usability strong.

Figure 4:
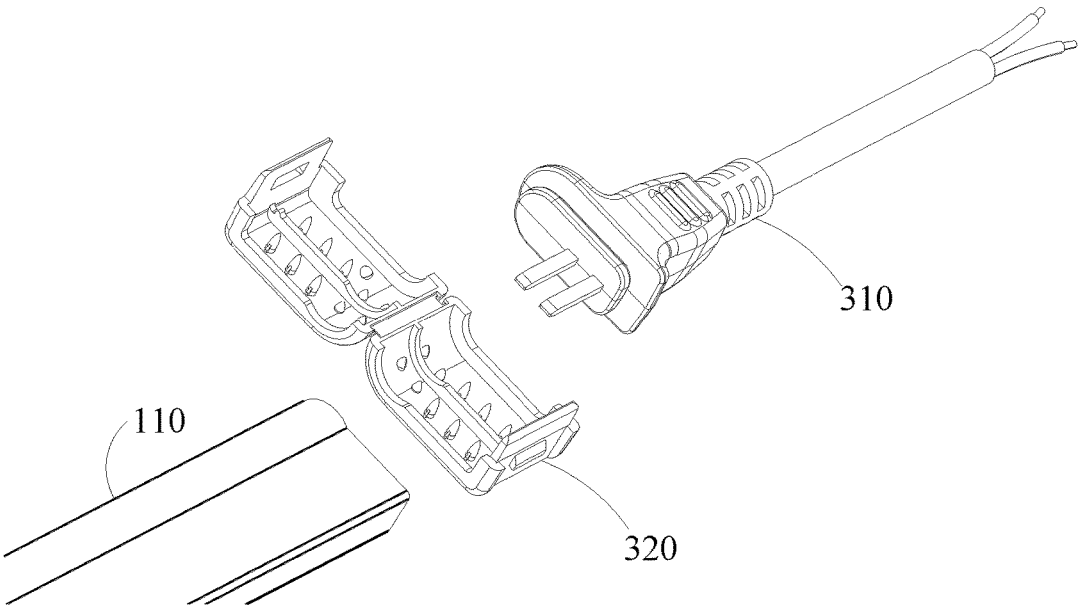
FIG. 4 is a structural schematic view of a first connecting assembly provided in a preferable example of the present disclosure.

Furthermore, the specific structure of the first connecting assembly 300 is shown in FIG. 4. The first connecting assembly 300 can include a first connecting element 310 and a first connecting housing 320. The first connecting element 310 is electrically connected with the light strip 110, and the first connecting housing 320 is snapped with the first connecting element 310.

Figure 5:
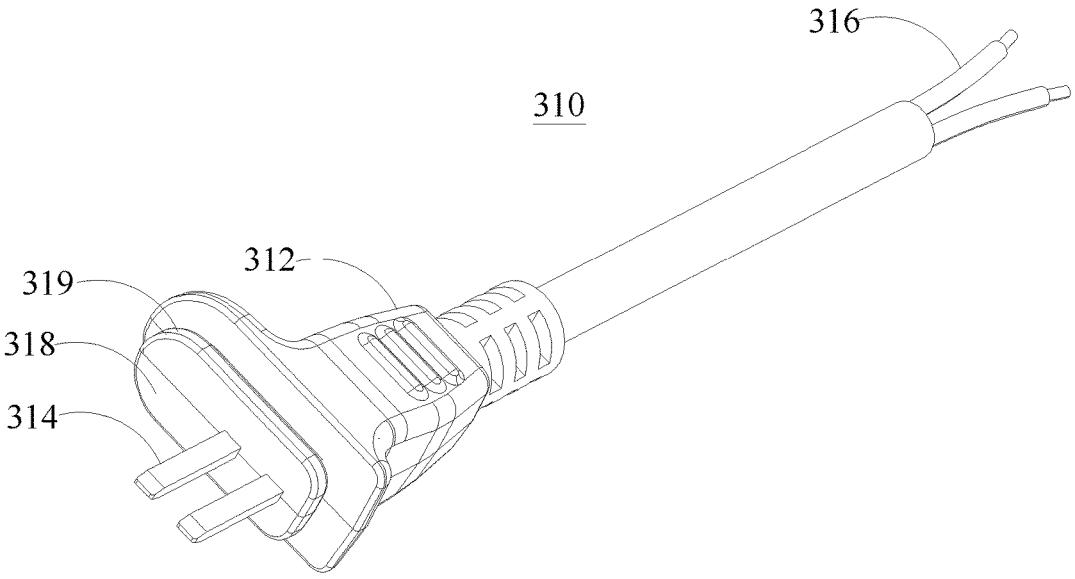
FIG. 5 is a structural schematic view of a first connecting element shown in FIG. 4.

The specific structure of the first connecting element 310 is shown in FIG. 5. The first connecting element 310 can include a first connecting element body 312, first plug pins 314, and power lines 316. The first plug pins 314 and the power lines 316 are electrically connected with each other and are respectively arranged at two opposite ends of the first connecting element body 312, and the first plug pins 314 are electrically connected with the light bar 110 for directing the current passing through the power lines 316 into the light bar 110.

As one implementation, a first stopper 318 is provided on the first connecting element body 312, and a first clamping groove is formed between the first stopper 318 and the first connecting element body 312. A stepped structure is formed with the first clamping groove 319 and the first stopper 318.

Figure 6:
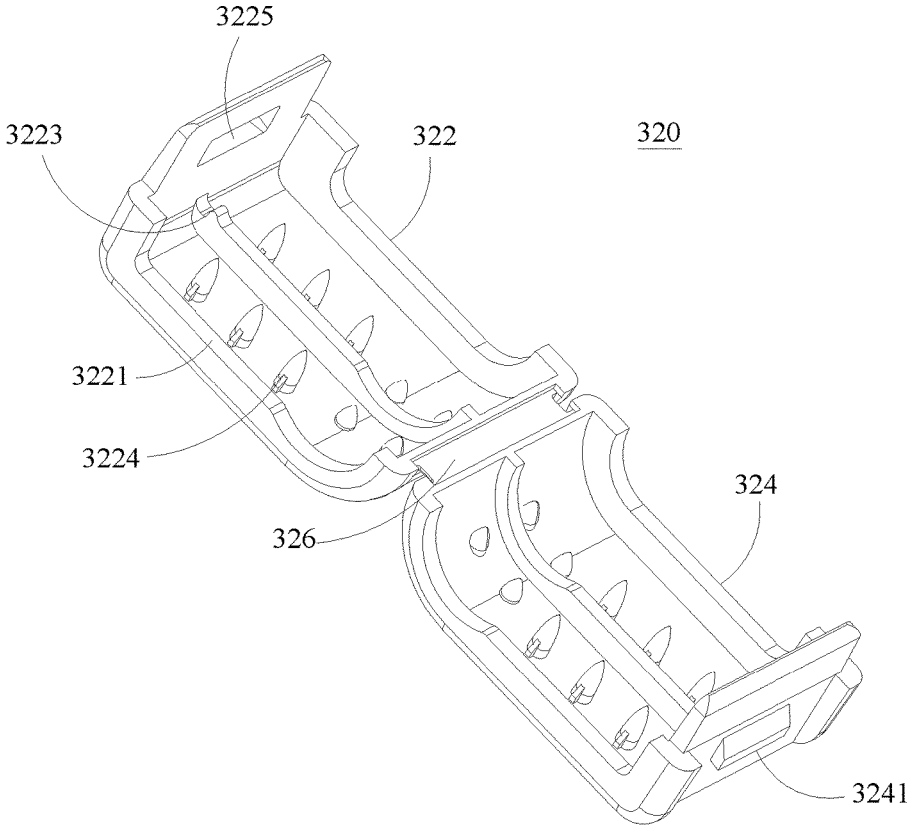
FIG. 6 is a structural schematic view of a first connecting housing shown in FIG. 4.

The specific structure of the first connecting housing 320 is shown in FIG. 6. In the present example, the first connecting housing 320 can include a first housing 322 and a second housing 324. Optionally, the first housing 322 and the second housing 324 can be provided with a folding spine 326 therebetween, and the first housing 322 and the second housing 324 can rotated with the folding spine 326 as a shaft.

The folding spine 326 can be used to be in cooperation with the superposition of the first housing 322 with the second housing 324. The first housing 322 and the second housing 324 can rotate and snap-fit towards each other and form space for receiving a portion where the first connecting element 310 and the light strip 110 are mutually connected.

The first housing 322 and the second housing 324 are provided with a first clamping part 3221, a protrusion and second gripping teeth 3224, the protrusion is configured for preventing the first housing 322 and the second housing 324 which are superposed one on another from rebounding, the second gripping teeth 3224 are configured for gripping the light strip 100. In combination with the figures, the first clamping part 3221 is snapped with the first clamping groove 319 for fixing the first connecting element 310 and the first connecting housing 320.

In addition, the first housing 322 is provided thereon with a first snap-fitting element 3225, and the second housing 324 is provided thereon with a first snap-fitting hole 3241, and the first snap-fitting element 3225 is in cooperation with the first snap-fitting hole 3241 to fix the first housing 322 and the second housing 324.

A first snap-fitting plate is provided on one end of the first housing 322 away from the second housing 324, the first snap-fitting element hole 3241 is provided on the first snap-fitting plate, and a fixing groove is formed between the protrusion 3223 of the first housing 322 and the first snap-fitting plate. A second snap-fitting plate is provided on one end of the second housing 324 away from the first housing 322, and the first snap-fitting 3225 is provided in the second snap-fitting plate. In a state that the first snap-fitting element 3225 is in cooperation with the first snap-fitting hole 3241, the second snap-fitting plate is embedded in the fixing groove, and the side wall of the first snap-fitting plate abuts against the protrusion 3223.

Neither weld lines nor fastening elements (for example, screws) are used in the above design of the first connecting assembly 300, and thus it is simple and convenient to assemble with strong usability.

Figure 7:
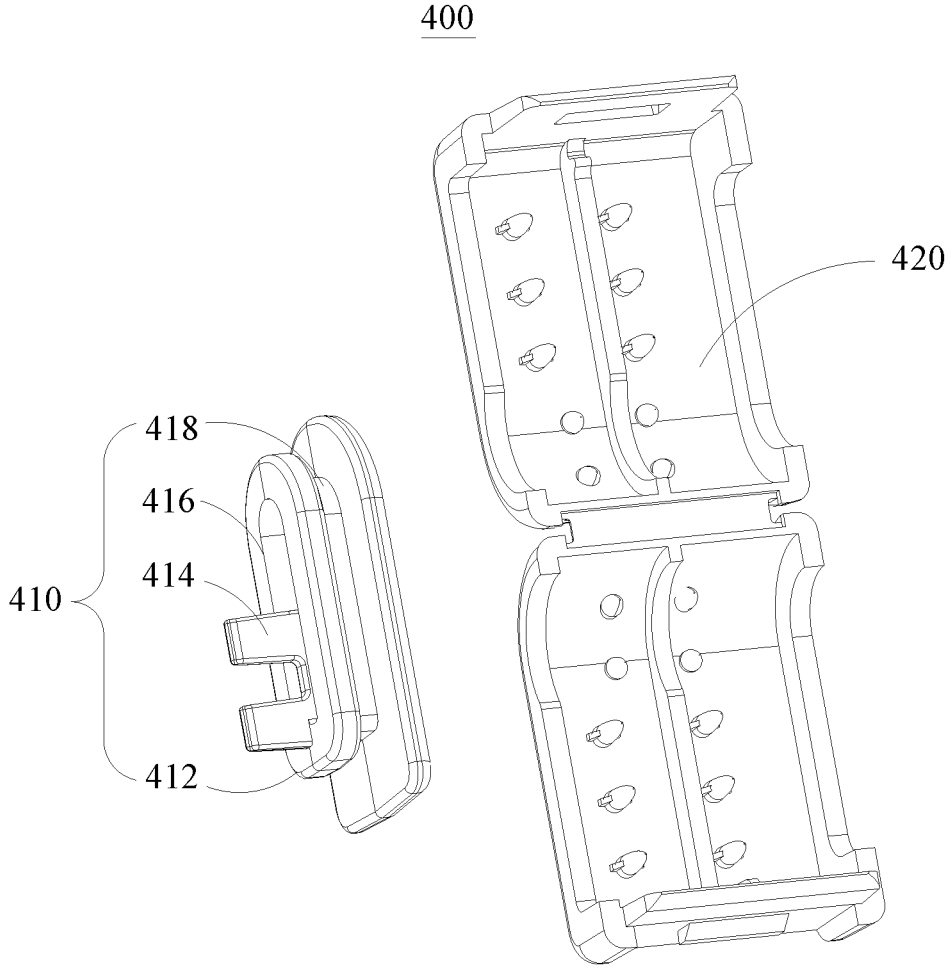
FIG. 7 is a structural schematic view of a second connecting assembly provided in a preferable example of the present disclosure.

Furthermore, referring to FIG. 7, the second connecting assembly 400 can include a second connecting element 410 and a second connecting housing 420. The second connecting element 410 is connected with the light strip 110, and the second connecting housing 420 is snapped to the second connecting element 410.

Optionally, the second connecting element 410 can include a second connecting element body 412 and a short tongue-shaped member-shaped member 414. One end of the short tongue-shaped member 414 is connected with the second connecting element body 412, and the other end is connected with the light bar. Furthermore, a second stopper 416 is provided on the second connecting element body 412, and a second clamping groove 418 is formed between the second stopper 416 and the second connecting element body 412 for snapping the second connecting assembly 400 to the second connecting housing 420.

In the present example, reference can be made to the above description of the first connecting housing 320 for the specific structure of the second connecting housing 420, and any details will not be necessary herein.

Neither weld lines nor fastening elements (for example, screws) are used in the above design of the second connecting assembly 400, and thus it is simple and convenient to assemble with strong usability.

Figure 8:
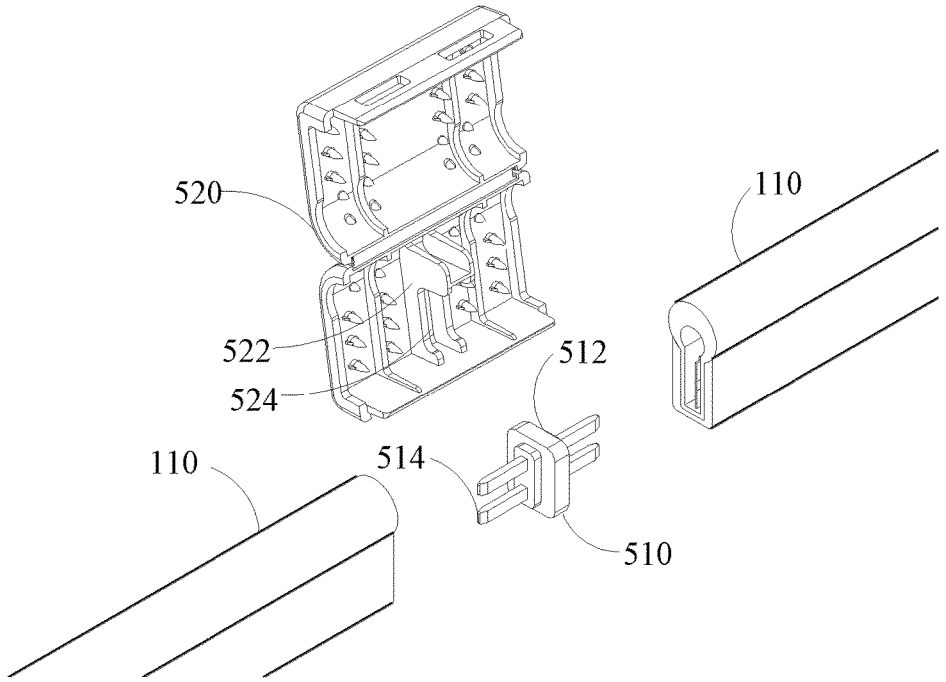
FIG. 8 is a structural schematic view of a third connecting assembly provided in a preferable example of the present disclosure.

Furthermore, referring to FIG. 8, the third connecting assembly 500 includes a third connecting element 510 and a third connecting housing 520. Two ends of the third connecting element 510 are respectively connected with the adjacent light bars 110, and the third connecting housing 520 is snapped and fixed with the third connecting element 510.

Optionally, as shown in FIG. 8, the third connecting element 510 can include a third connecting element body 512 and third plug pins 514 arranged at two ends of the third connecting element body 512, and the third plug pins 514 at the two ends are respectively electrically connected with the adjacent light bars 110.

The third connecting housing 520 is structurally similar to the first connecting housing 320, specially, referring to the above description of the first connecting housing 320. The difference is that the third connecting housing 520 is further provided with a plurality of pairs of skeleton members 522, and third clamping grooves 524 are formed between the skeleton members 522 of each pair and configured for clamping the third connecting elements 510.

Neither weld lines nor fastening elements (for example, screws) are used in the above design of the third connecting assembly 500, and thus it is simple and convenient to assemble with strong usability.

By adopting the above design of the first connecting element 300, the second connecting element 400, and the third connecting element 500, the LED light strip 10 can be individually customized, and adjustment in dimension or structure can be made in different application environments. Moreover, the installation is simple and convenient, and the user can learn it fast. Therefore, the LED light strip 10 enjoys extremely strong environmental adaptability.

In addition, the above design of the first connecting assembly 300, the second connecting assembly 400, and the third connecting assembly 500 is mainly directed to the LED light strip 10 as a product with a general straight structure. In general, the LED light strip 10 can also have a more complex structure so as to be applied to different external environments that are more complex. For example, a plurality of light strips 110 included in the LED light strip 10 not only can be connected through straight lines, but also can be connected through right angles, or alternatively, they can be connected through other angles.

Exemplarily, a technical solution of the present example will be briefly described below by taking the example of two light strips 110 that are connected at a right angle.

Figure 9:
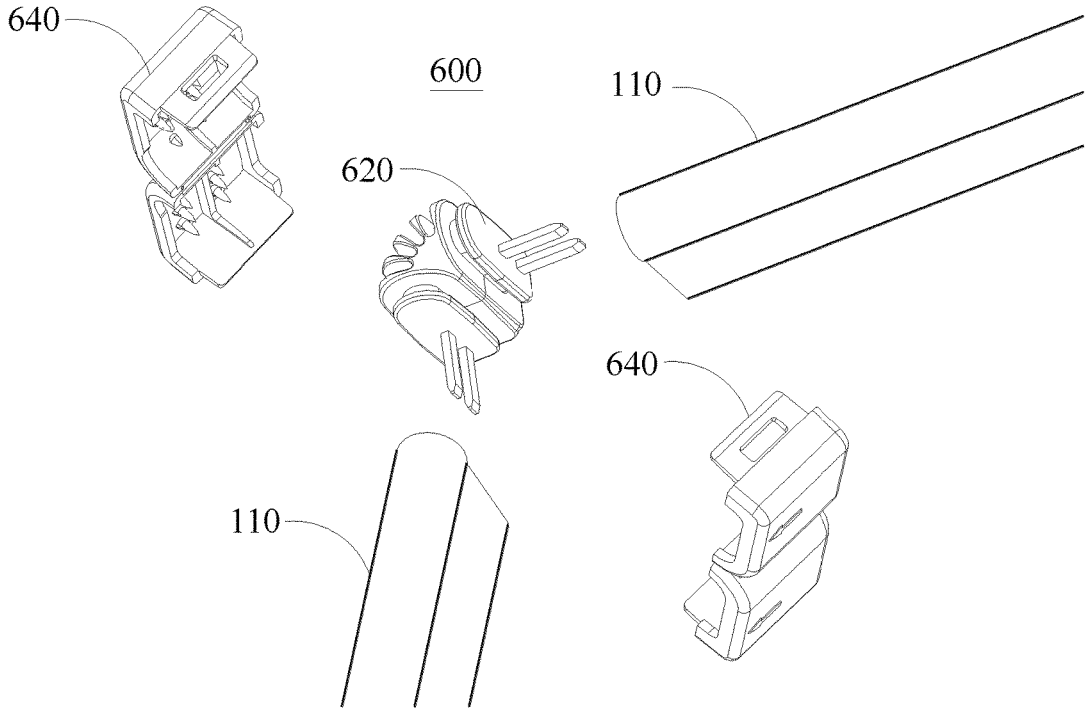
FIG. 9 is a structural schematic view of a fourth connecting assembly provided in a preferable example of the present disclosure.

Referring to FIG. 9, in the present example, a fourth connecting assembly 600 can be further provided between the adjacent light strips 110, and the fourth connecting assembly 600 can be used for connecting two light bars 110 that are mutually perpendicular.

Optionally, the fourth connecting assembly 600 can include a fourth connecting element 620 and two fourth connecting housings 640, the fourth connecting element 620 is respectively connected with the two mutually perpendicular light bars 110, and the two fourth connecting element 620 are clamped in and fixed to the fourth connecting housings 640.

Figure 10:
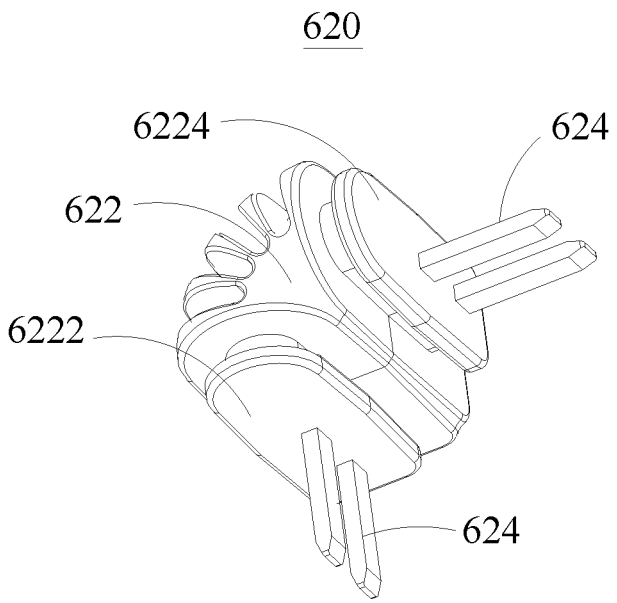
FIG. 10 is a structural schematic view of a fourth connecting element shown in FIG. 9.

Optionally, the specific structure of the fourth connecting element 620 is shown in FIG. 10. The fourth connecting assembly 600 can include a fourth connecting element body 622 and fourth plug pins 624. The fourth connecting element body 622 includes a first side face 6222 and a second side face 6224. The direction of a plane where the first side face 6222 is located is mutually perpendicular to the direction of a plane where the second side face 6224 is located. The fourth plug pins 624 are respectively arranged on the first side face 6222 and the second side face 6224, for respectively electrically connecting with the two mutually perpendicular light bars 110.

It should be noted that in other examples, the two light bars 110 may not be perpendicular to each other, and can be arranged with other angles. Correspondingly, an angle between the direction of the plane where the first side face 6222 is located and the direction of the plane where the second side face 6224 is located can be set according to an angle between extending directions of the two light bars 110.

An illumination system is further provided in a preferable example of the present disclosure. The illumination system includes a power supply system and the LED light strip 10 of the above examples, where the power supply system is electrically connected with the LED light strip 10 for supplying power to the LED light strip 10.

To sum up, this disclosure provides a LED light strip 10 and an illumination system, where the LED light strip 10 is provided with the light strip 100, the mounting groove 200, the first connecting assembly 300, the second connecting assembly 400, and the third connecting assembly 500. The light strip 100 provided in the mounting groove 200 includes the opposite first end portion and second end portion. The first connecting assembly 300 is connected with the first end portion for connecting the light strip 100 to the external power supply, and the second connecting assembly 400 is connected with the second end portion for blocking off the second end portion. A plurality of light strips 110 are provided between the first end portion and the second end portion, and the third connecting assembly 500 is provided between the adjacent light strips 110 for electrically connecting the adjacent light strips 110. Each light strip 110 includes the outer housing 112, the circuit board 114, and the LED lamp 116, where a gap is present between the LED lamp 116 arranged on the circuit board 114, and the outer housing 112 within which the circuit board 114 is arranged. The above design is able to satisfy the application requirements in different environments as it can flexibly adjust structure or dimension according to different environments, with simple structure, convenient assembly, low manufacture cost, and strong environment adaptability.

For a person skilled in the art, the present disclosure apparently is not limited to the details of the above exemplary examples, and the present disclosure can be implemented in other specific forms without departing from the spirit or basic features of the present disclosure. Therefore, in all respects, the examples should be considered as exemplary and non-restrictive, and the scope of the present disclosure is defined by the enclosed claims rather than the above description. Therefore, all variations falling within the meaning and scope of equivalents of the claims are intended to be encompassed within the present disclosure. Any reference signs in the claims should not be considered as limiting the claim concerned.

The invention claimed is:

1. A light-emitting diode (LED) light strip comprising:
- a first connecting assembly;
- a second connecting assembly;
- a third connecting assembly;
- a light strip comprising a first end portion and a second end portion which are opposite to each other, wherein the first connecting assembly is connected with the first end portion and configured for electrically connecting the light strip with an external power supply, and the second connecting assembly is connected with the second end portion and configured for blocking off the second end portion;
- a mounting groove with the light strip arranged in the mounting groove, the mounting grove comprising:
  - a mounting groove body configured for receiving the light strip; and
  - a mounting-groove snap-fitting element configured for fixing the light strip in the mounting groove body, wherein the mounting-groove snap-fitting element is fixed in the mounting groove body; and
- a plurality of light bars arranged between the first end portion and the second end portion, wherein the third connecting assembly is arranged between adjacent light bars and configured for electrically connecting the adjacent light bars, and
- each of the light bars comprises:
  - an outer housing;
  - a circuit board arranged within the outer housing along an extending direction of the light bar; and
  - an LED lamp arranged on the circuit board, wherein a gap is formed between the LED lamp and the outer housing.

2. The LED light strip according to claim 1, wherein the mounting groove body comprises: positioning grooves configured for fixing the mounting-groove snap-fitting element, and a plurality of mounting holes configured for mounting the LED light strip in an external environment.

3. The LED light strip according to claim 2, wherein the mounting groove body has two side plates arranged opposite to each other, and a connecting plate connected between the two side plates, each of the side plates is provided with at least two snap-fitting element stoppers and at least one of the positioning grooves, the at least one of the positioning grooves is located between two adjacent snap-fitting element stoppers, the positioning grooves of the two side plates are corresponding to each other, and the connecting plate is provided with the mounting holes.

4. The LED light strip according to claim 3, wherein the mounting groove body is in a substantially V-shaped structure, and the connecting plate is connected at ends, located at a same side, of the two side plates.

5. The LED light strip according to claim 2, wherein the mounting-groove snap-fitting element comprises a limiting portion and two clamping portions;

the limiting portion is located between the two clamping portions, the limiting portion is configured to be in contact with the light strip so as to limit the light strip, and the two clamping portions are configured to cooperate with the limiting portion so as to clamp and fix the light strip within the mounting groove; and the two clamping portions are provided thereon with a plurality of first gripping teeth configured for gripping the light strip, and handlebars configured for detaching the mounting-groove snap-fitting element.

6. The LED light strip according to claim 5, wherein the two clamping portions respectively abut against inner sides of two side plates of the mounting groove body, and the handlebars are snap-fitted with the positioning grooves.

7. The LED light strip according to claim 1, wherein the first connecting assembly comprises a first connecting element and a first connecting housing;

the first connecting element comprises a first connecting element body, first plug pins and power lines, the first plug pins and the power lines are electrically connected with each other and are respectively arranged at two opposite ends of the first connecting element body, and the first plug pins are electrically connected with one of the light bars so as to direct current from the power lines into the one of the light bars; and a first stopper is provided on the first connecting element body, and a first clamping groove is formed between the first stopper and the first connecting element body; the first connecting housing is locked by the first clamping groove so as to fix the first connecting element with the first connecting housing.

8. The LED light strip according to claim 7, wherein the first connecting housing comprises a first housing and a second housing, a folding spine is provided between the first housing and the second housing and configured for making the first housing and the second housing superposed one on another, the first housing and the second housing each are provided thereon with a first clamping part, a protrusion and second gripping teeth, the protrusion is configured for preventing the first housing and the second housing which are superposed one on another from rebounding, and the second gripping teeth are configured for gripping the light strip; and the first clamping part is clamped in the first clamping groove so as to fix the first connecting element with the first connecting housing.

9. The LED light strip according to claim 8, wherein the first housing is provided thereon with a first snap-fitting element, the second housing is provided with a first snap-fitting hole, and the first snap-fitting element is in cooperation with the first snap-fitting hole so as to fix the first housing with the second housing.

10. The LED light strip according to claim 9, wherein a first snap-fitting plate is provided at one end of the first housing away from the second housing, the first snap-fitting hole is provided in the first snap-fitting plate, and a fixing groove is provided between the protrusion of the first housing and the first snap-fitting plate; a second snap-fitting plate is provided at one end of the second housing away from the first housing, and the first snap-fitting element is provided in the second snap-fitting plate; and the second snap-fitting plate is embedded in the fixing groove, and a side wall of the first snap-fitting plate abuts against the protrusion.

11. The LED light strip according to claim 1, wherein the second connecting assembly comprises a second connecting element and a second connecting housing;

the second connecting element comprises a second connecting element body and a short tongue-shaped member, one end of the short tongue-shaped member is connected with the second connecting element body, and other end of the short tongue-shaped member is connected with one of the light bars; and a second stopper is provided on the second connecting element body, and a second clamping groove is formed between the second stopper and the second connecting element body and configured for making the second connecting element clamped in the second connecting housing.

12. The LED light strip according to claim 1, wherein the third connecting assembly comprises a third connecting element and a third connecting housing;

the third connecting element comprises a third connecting element body and third plug pins, the third plug pins are provide at two ends of the third connecting element body, and the third plug pins at the two ends are respectively electrically connected with adjacent light bars; and the third connecting housing is provided thereon with a plurality of pairs of skeleton members, and a third clamping groove is formed between the skeleton members of each pair and configured for clamping the third connecting element.

13. The LED light strip according to claim 1, wherein a fourth connecting assembly is further provided between adjacent light strips and configured for connecting two light bars perpendicular to each other, the fourth connecting assembly comprises a fourth connecting element and two fourth connecting housings;

the fourth connecting element comprises a fourth connecting element body and fourth plug pins, the fourth plug pins are electrically connected with the two light bars perpendicular to each other, and the fourth plug pins are connected with the fourth connecting element body; and the fourth connecting element is clamped in and fixed with one of the fourth connecting housings.

14. An illumination system, wherein the illumination system comprises a power supply system and the LED light strip according to claim 1, and the power supply system is electrically connected with the LED light strip for supplying power to the LED light strip.

15. The illumination system according to claim 14, wherein the mounting groove body comprises: positioning grooves configured for fixing the mounting-groove snap-fitting element, and a plurality of mounting holes configured for mounting the LED light strip in an external environment.

16. The illumination system according to claim 15, wherein the mounting groove body has two side plates arranged opposite to each other, and a connecting plate connected between the two side plates, each of the side plates is provided with at least two snap-fitting element stoppers and at least one of the positioning grooves, the at least one of the positioning grooves is located between two adjacent snap-fitting element stoppers, the positioning grooves of the two side plates are corresponding to each other, and the connecting plate is provided with the mounting holes.

17. The illumination system according to claim 16, wherein the mounting groove body is in a substantially V-shaped structure, and the connecting plate is connected at ends, located at a same side, of the two side plates.

18. The illumination system according to claim 15, wherein the mounting-groove snap-fitting element comprises a limiting portion and two clamping portions;

the limiting portion is located between the two clamping portions, the limiting portion is configured to be in contact with the light strip so as to limit the light strip, and the two clamping portions are configured to cooperate with the limiting portion so as to clamp and fix the light strip within the mounting groove; and the two clamping portions are provided thereon with a plurality of first gripping teeth configured for gripping the light strip, and s configured for detaching the mounting-groove snap-fitting element.

* * * * *